United States Patent [19]

Nakajima et al.

[11] Patent Number: 5,052,478

[45] Date of Patent: Oct. 1, 1991

[54] PIPE FOR COOLANT CONDENSER

[75] Inventors: Ichio Nakajima; Tsuneo Kousaka; Akio Matsushima, all of Isezaki, Japan

[73] Assignee: Yuugen Kaisha Marunaka Seisakusho, Gunma, Japan

[21] Appl. No.: 517,355

[22] Filed: May 1, 1990

[30] Foreign Application Priority Data

May 19, 1989 [JP] Japan ..... 1-56972[U]
Sep. 11, 1989 [JP] Japan ..... 1-106344

[51] Int. Cl.[5] ..... F28D 1/02

[52] U.S. Cl. ..... 165/153; 165/173; 29/890.052

[58] Field of Search ..... 165/153, 173, 176; 29/890.052

[56] References Cited

U.S. PATENT DOCUMENTS 4,615,385 10/1986 Saperstein et al. ..... 165/173
4,651,821 3/1987 Moranne ..... 165/173

*Primary Examiner*—Ronald C. Capossela
*Attorney, Agent, or Firm*—Bauer & Schaffer

[57] ABSTRACT

A header pipe is formed with a plurality of oblong slots which extend radially through the wall of the pipe and have an outside dimension larger than that of the tubular heat exchanger which is inserted in the slot. The peripherally directed edges on the exterior surface of the pipe surrounding the slots are curved to flare outwardly to form a taper for the insertion of the tubular heat exchanger.

6 Claims, 5 Drawing Sheets

PIPE FOR COOLANT CONDENSER

FIELD OF THE INVENTION

This invention relates to the construction of a header pipe for a coolant condenser used in automobile air conditioners.

PRIOR ART

The conventional coolant condenser of an air conditioner has the construction as shown in FIG. 11 and the function as shown in FIG. 12. Coolant is supplied from a left header pipe A, through an upper set of three tubes B to right header pipe C, from which it flows through an intermediate set of three tubes B to be returned to header pipe A. Then it is led from header pipe A through a lower set of three tubes B to header pipe C from which it exits. The coolant flows in a meandering or sinuous fashion through header pipe A, a plurality of tubes B, and header pipe C, and is pressurized for forced heat radiation to reduce it to low-temperature high pressure liquid coolant. Heat radiated at this time is transmitted to tubes B and thence to corrugated fins D provided between adjacent tubes B to be dissipated through air supplied thereto.

The header pipes A and C have the same structure and, as shown in FIGS. 11 and 12, are partitioned in the longitudinal direction by partitioning plates E. The header pipes A and C each have a plurality of radially elongate tube slots F formed by a press or stamping operation for receiving tubes B. Tubes B, when inserted, are secured by soldering K to the walls of slots F such that coolant will not leak. Tubes B are also soldered to the corrugated fins D.

When the tube slots F are formed by a stamping operation without the steps of inserting cores in the header pipes A and C, the edges X of slots F are convexedly turned and the pipe headers are deformed, making it difficult to insert tubes B through slots F. To avoid this in practice a core G having punch holes dimensioned to the size of the slot is axially inserted into the header pipe A and the press operation carried out after aligning the escapement hole H formed in core G and punch J (See FIGS. 15–17).

Meanwhile, in order to facilitate insertion of tubes B into tube slots F, the edges X are in practice further depressed, as shown in FIG. 19, thus forming broader inlets Y in slots F and also forming outwardly projecting peripheral wall portions M similar to domes between adjacent slots F.

PROBLEMS IN THE PRIOR ART

When using the stamping operation shown in FIGS. 15–17, the width W of the escapement hole H is only slightly greater than the width Z of the punch. Therefore, the peripheral wall of the header pipe A is sheared immediately after the start of the press operation, and the throat edge X of the tube insertion hole F is substantially perpendicular to the pipe periphery, as shown in FIG. 17. In this case, tube B can be inserted through tube insertion hole F only with difficulty. In addition, if tube B is inserted obliquely, it will be most difficult to withdraw it, and thus, reinsertion of the tube becomes cumbersome.

Further, as shown in FIG. 14, the area of the solder zone K between tube B and pipe A is reduced. That is, the mechanical strength of soldering is reduced, giving rise to the possibility of leakage of coolant.

In order to solve this problem, it may be thought to broaden the edge of tube insertion hole F by chamfering edge X after formation of the hole F. Doing so, however, increases the steps of the manufacturing operation—that is, it requires added time and labor, leading to an increase in cost.

When the dome-like peripheral wall portions M are formed between tube slots F of pipes A and C as shown in FIG. 19, there is the following problem:

Although the longitudinal edge portions X of tube insertion hole F are depressed as shown in FIGS. 18 and 19, the end portions M of the edges of the slots F (FIG. 18) are not depressed but remain substantially perpendicular to the pipe periphery. Therefore, when inserting tube B through tube insertion hole F, while a central portion of tube B in the width direction thereof is guided by depressed edge X and can be readily inserted, the end portions to tube B in the width direction can only be inserted with very great difficulty, particularly if they become slightly oblique or deviated with respect to tube insertion hole F. Besides, if tube B is obliquely inserted with irrational force, reinsertion become cumbersome, thus making the assembling very cumbersome.

OBJECT OF THE INVENTION

An object of the invention is to provide a header pipe for a coolant condenser, which permits ready insertion of the tubes through its receiving slots; provides for increased soldering area for securing the tubes; increases mechanical strength; and is inexpensive in price.

SUMMARY OF THE INVENTION

According to the present invention, there is provided a header pipe for a coolant condenser used for automobile air conditioners as shown in FIG. 1, in which the pipe 1 has radially elongated tube insertion slots 2, into which tubes B are received. The tube insertion hole 2 has an edge 3 which is broader than the outer diameter of tube B, and the edge 3 is formed with outwardly flaring curved guide surface 4.

Further, according to the present invention, as shown in FIGS. 6–10, each radially elongated tube insertion hole 3 has outwardly flaring guide portions 22 formed at opposite lateral ends 7 in the longitudinal direction of the hole.

DETAILED DESCRIPTION OF THE INVENTION

Embodiments of the Invention

Figure 1:
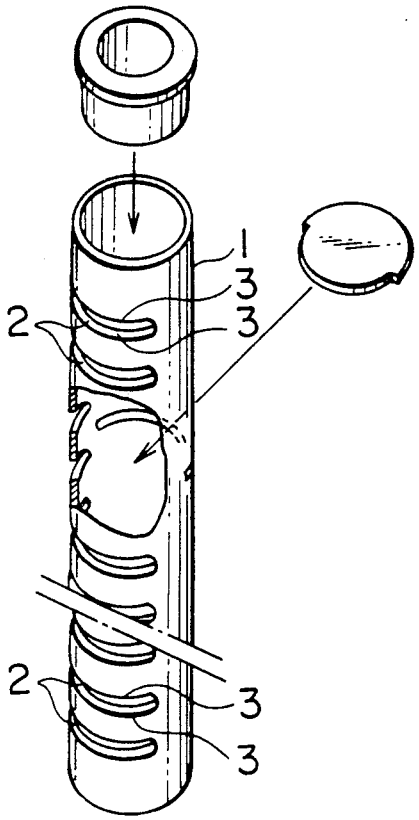
FIG. 1 is a perspective view showing an embodiment of the pipe for a coolant condenser according to the invention.
Figure 2:
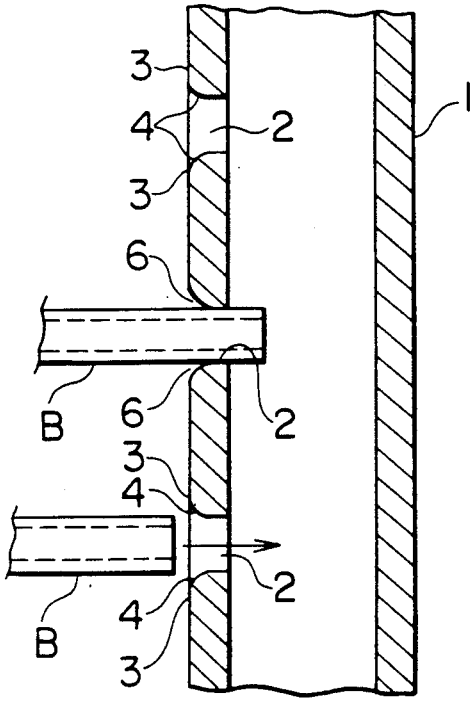
FIG. 2 is a sectional view showin a manner of inserting a tube in a pipe shown in FIG. 1.

As seen in FIGS. 1 and 2, the header pipe according to the invention is referred to generally by the numeral 1 and is provided with radially oblong slots 2 for receiving the ends of tubes B. The tube receiving slots 2 each have edges 3 which are broader than the width dimensions of tube B. The edges 3 are bevelled to provide outwardly flaring curved guide surfaces 4 as shown in FIG. 2.

Figure 3:
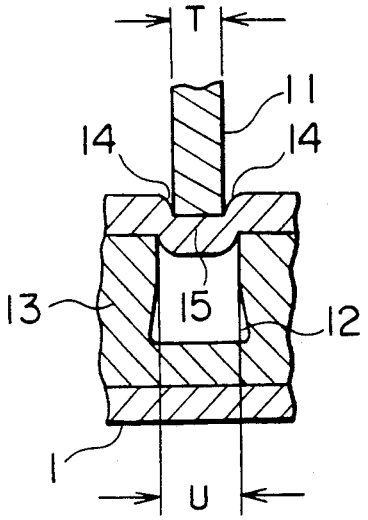
FIGS. 3 to 5 are views for explaining a process of forming a tube insertion hole in the pipe.

As shown in FIG. 3, the bevelled surfaces 4 are formed, employing a punch 11 in combination with an escapement hole 12 in core 13. The punch 11 has a width T which is equal to or slightly less than the width of the receiving hole 2 which is to be formed, while the escapement hole 12 has a width U which is greater than the width of the receiving hole 2. As a specific example, with the width of tube insertion hole 2 set to 2.1 mm, punch 11 has width T of 2.0 mm, and the width U of escapement hole 12 is 2.5 mm.

Figure 4:
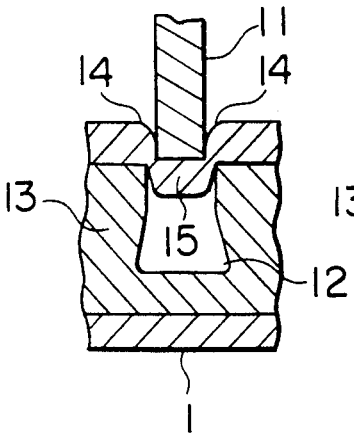
Figure 5:
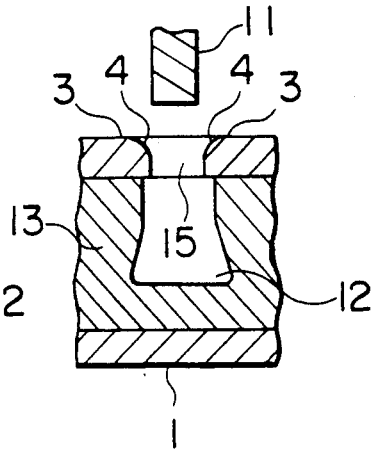
Figure 6:
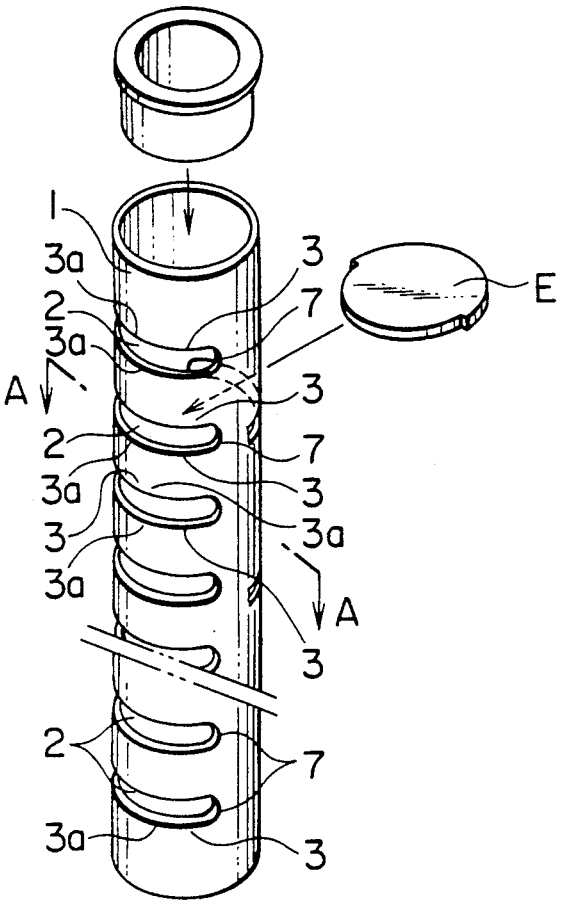
FIG. 6 is a perspective view showing a different embodiment of the pipe for a coolant condenser according to the invention.

The stamping operation is performed after aligning the punch 11 and escapement hole 12. In this operation, the peripheral wall 15 of the header pipe 1 is not immediately sheared because the escapement hole 12 is greater in dimensions than punch 11. More specifically, as shown in FIG. 3, for a while after the commencement of the stamping operation, the peripheral wall 15 is pushed without shearing by punch 11 into escapement hole 12, where it is eventually curved inwardly as shown in FIG. 4. With the operation continued from this state, the peripheral wall 15 is eventually stamped out, and thus tube insertion hole 2 is formed. At this time, curved guide surface 4 (i.e. chamfered edge) is formed as part of peripheral wall 15 at the edge 3 of the hole 2.

It will be seen that tube receiving hole 2 and curved guide surface 4 are formed in a single stamping operation. in this case, if the difference between the width T of the punch 11 and the width U of escapement hole 12 is excessive, burrs are liable to be formed on the inner edge of the hole 2. For this reason, the width T of punch 11 and width U of escapement hole 12 are closely selected such that no burrs will be formed.

FIGS. 6–10 show other embodiments of the invention.

Referring to these figures, the header pipe 1 has its peripheral wall stamped with radially elongate tube receiving slots 2 for inserting tubes B therethrough. The edge 3 of each hole 2 is formed with longitudinally extending portions 3*a* are depressed during the stamping operation into a shape facilitating the insertion of tube B.

The opposite ends 7 of the receiving hole 2 are formed with bevelled insertion guides 22, as shown in FIGS. 7 to 10. These guides 22 serve to permit ready insertion of tube B into the hole 2 even if tube B is inclined with respect to the width direction of the hole or deviated sidewise when inserting the tube.

Figure 7:
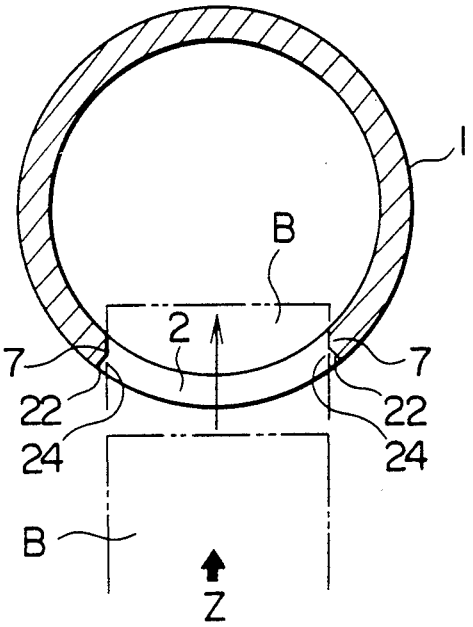
FIG. 7 is a sectional view taken along line A—A in FIG. 6.
Figure 8:
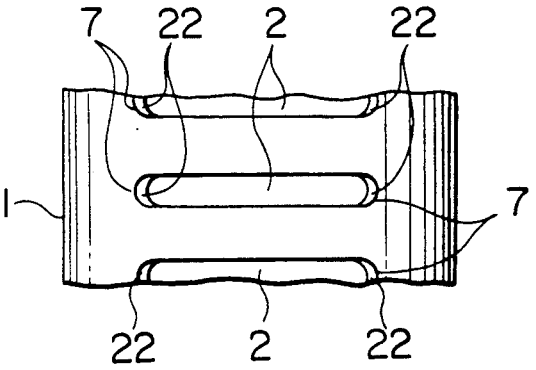
FIG. 8 is a fragmentary side view taken in the direction of arrow Z in FIG. 7.

The bevelled insertion guides 22 shown in FIGS. 7 and 8 are linearly chamfered such that they flare outwardly.

Figure 9:
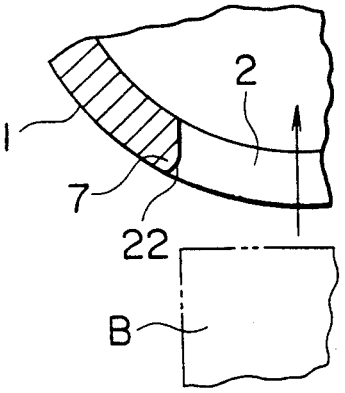
FIGS. 9 and 10 are fragmentary sectional views showing different embodiments of the pipe for a coolant condenser according to the invention.

The bevelled insertion guides 22 shown in FIG. 9 are chamfered in a curved fashion such that they flare outwardly.

Figure 10:
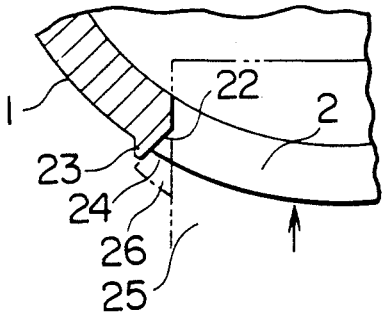
Figure 11:
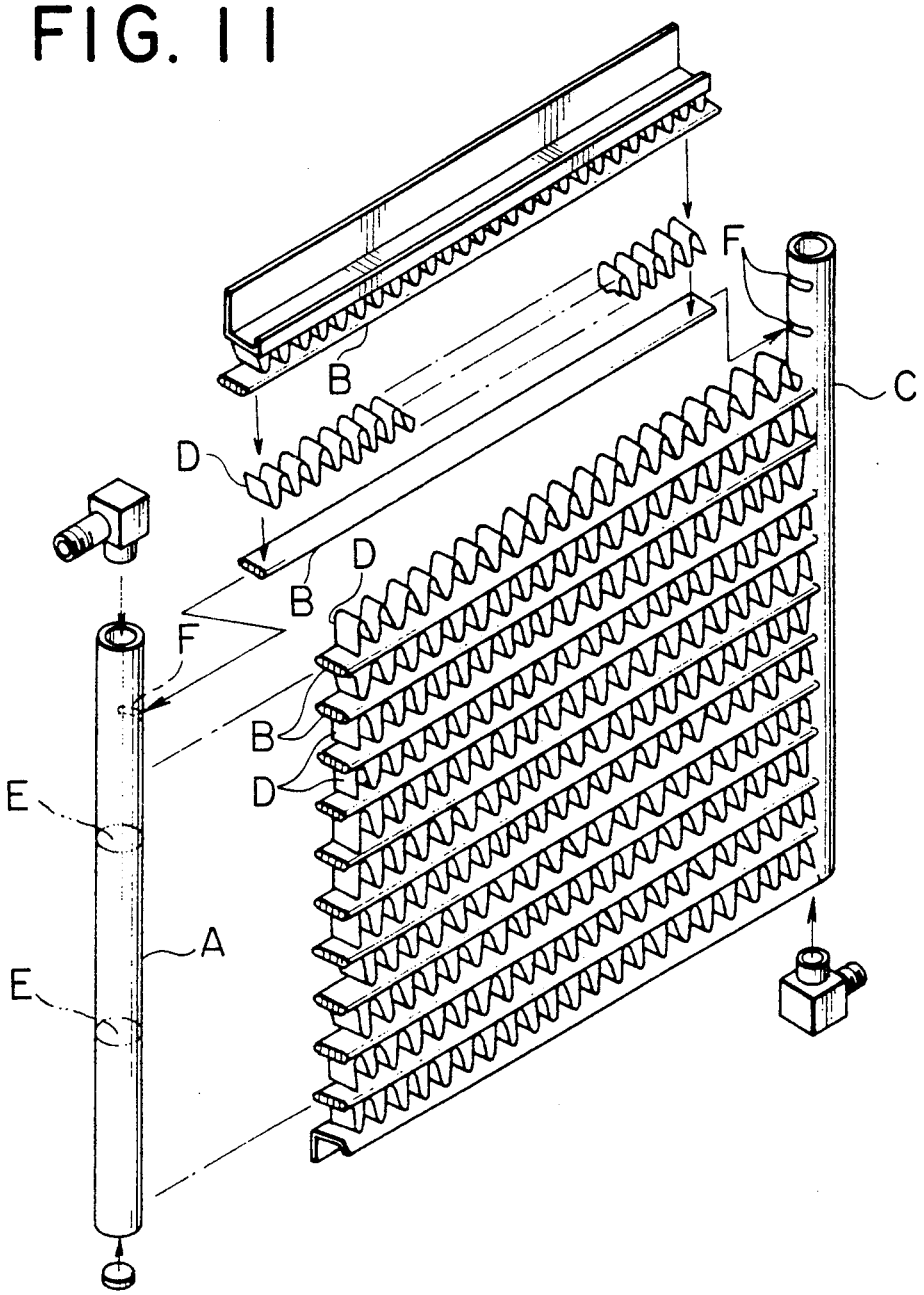
FIG. 11 is a view showing a coolant condenser.
Figure 12:
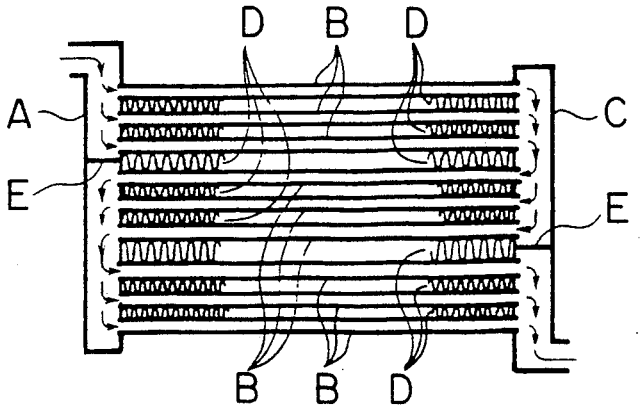
FIG. 12 is a view for explaining flow of coolant in the coolant condenser.
Figure 13:
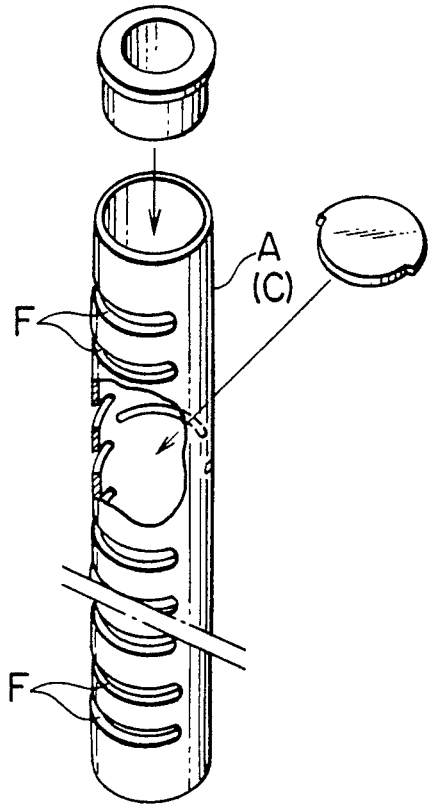
FIG. 13 is a perspective view showing a prior art pipe for a coolant condenser.
Figure 14:
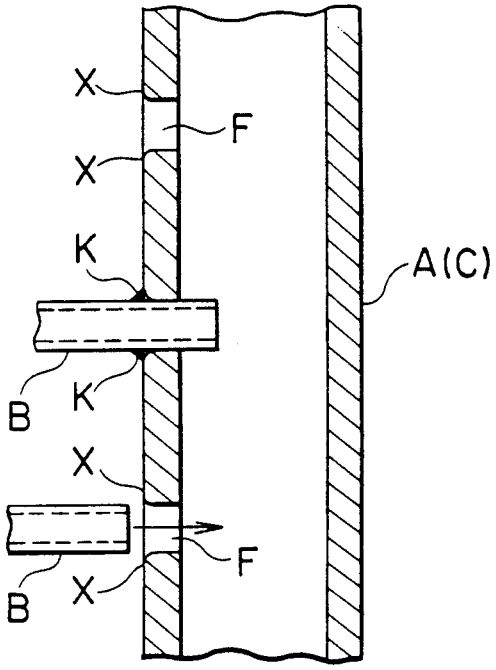
FIG. 14 is a sectional view showing a manner of inserting a tube in the pipe shown in FIG. 13.
Figures 15, 16, 17:
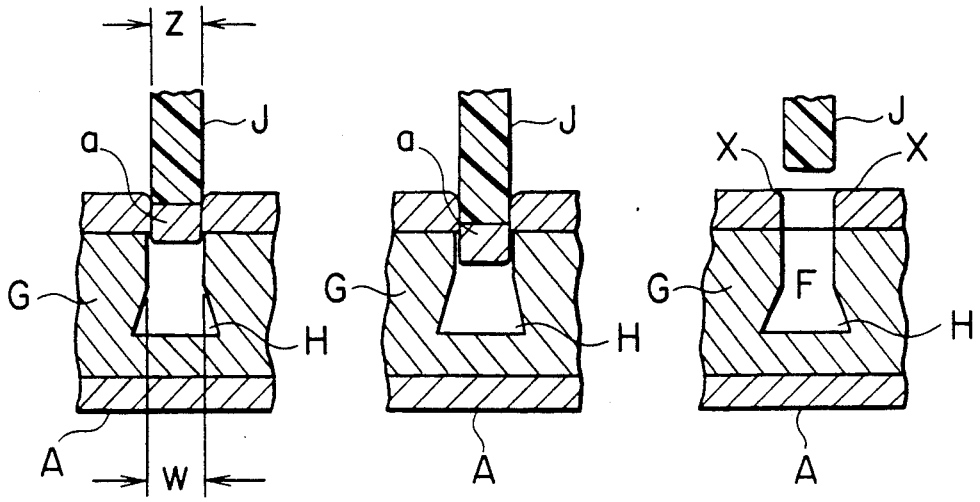
FIGS. 15–17 are views illustrating a process of forming a tube insertion hole in a pipe in the prior art.
Figure 18:
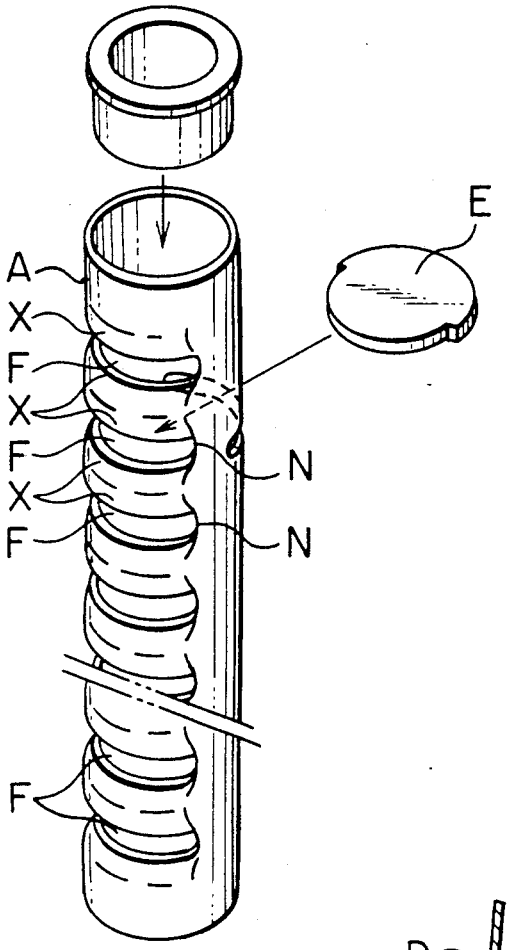
FIG. 18 is a perspective view showing a different prior art pipe for a coolant condenser.
Figure 19:
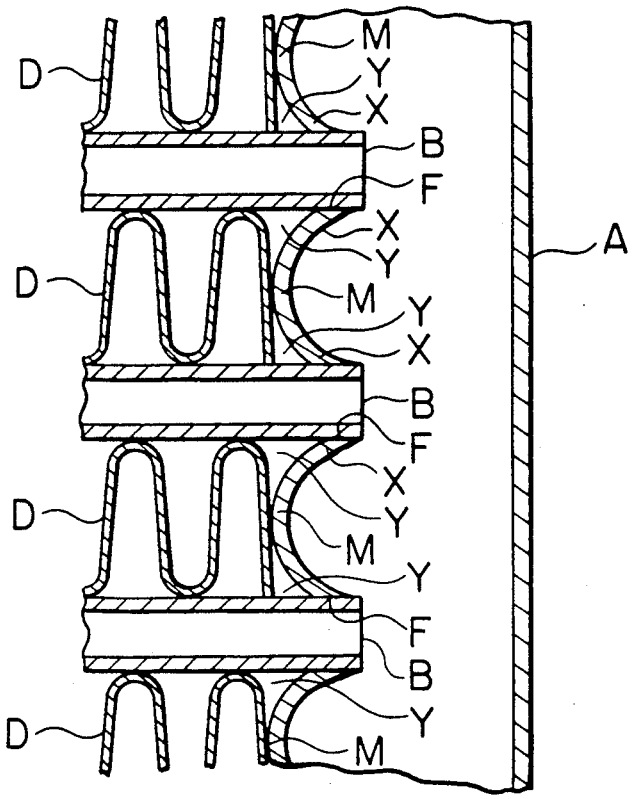
FIG. 19 is a sectional view showing the pipe of FIG. 18 together with inserted tubes and mounted fins.

The bevelled insertion guides 22 shown in FIG. 10 flare linearly outwardly and have outer guide projections 23. To form these tube insertion guides 23, the receiving hole 2 is formed by stamping in the direction of arrow in FIG. 10 using stamping punch 25 with projections 26 having the same shape as guides 22. By so doing, a single press operation simultaneously forms tube insertion hole 2 and the guide projections 23, all as a result of outward shift of excess material from the outer periphery of pipe 1 as shown in FIG. 10. With the formation of guide projections 23 a gap 24 is formed between tube B and pipe 1 when tube B is inserted into hole 2 is increased. Thus, the soldering area of pipe 1 and tube B is increased to improve the mechanical strength of soldering.

While the insertion guides 22 shown in FIGS. 7–10 are formed at the opposite ends of hole 2 in the longitudinal direction, it is possible to form a guide only at one end of the tube insertion hole.

Status of Use of the Invention

As will be appreciated, the slots 2 are formed with straight, radially directed walls which are curved, chamfered, or otherwise tapered only on the exterior surface of the pipe, forming the inlet to the slot. The long edge 3 of receiving hole 2 is broader than the outer dimensions of tube B inserted through tube insertion hole 2, and edge 3 is formed with outwardly flaring curved guides 4 as shown in FIG. 2. Thus, even if tube B is slightly deviated in position or bent when it is inserted through hole 2, it can be guided by curved guides 4 to correct the deviation or it may be bent and eventually inserted perpendicularly.

Further, since gap 6 is formed between each curved guide 4 of the hole 2 and tube B is inserted through hole 2, the area of soldering of tube B to pipe 1 is increased, and solder fills the gap 6, 26. Thus, the mechanical strength of soldering is increased.

Further, each header pipe shown in FIGS. 6–10 has radially elongate tube insertion slots 2 which are formed with outwardly flaring tube insertion guides 22 at opposite ends 7 in its longitudinal direction. Thus, even if tube B is slightly deviated in position or bent when it is inserted through the hole 2, its position can be corrected as it is guided by the guides 22 until it is eventually perpendicularly inserted.

Advantages of the Invention

The pipe for a coolant condenser according to the invention has the following advantages:

1) Curved guides 4 formed along the edge 3 of each tube insertion hole 2 or tube insertion guides 22 formed at opposite ends 7 of the hole 2 in the longitudinal direction thereof have the effect of correcting possible deviations or any bend of tube B, at the time of insertion. Thus, the insertion of tube B is greatly facilitated.

2) Since gap 6 is formed between tube B inserted through tube insertion hole 2 and each curved guide 4 or gap 24 is formed between tube B inserted through tube insertion hole 2 and each tube insertion guide 22, the soldering area is increased, resulting in greater mechanical strength and reducing the danger of leakage.

3) By forming guide projections 23 such that they project outwardly from the peripheral wall of pipe 1, gap 24 is increased to further increase the soldering area, further increasing the mechanical strength of soldering.

4) By arranging curved guides 4 or tube guides 22 simultaneously with hole 2 by a press operation, it is possible to reduce expenditures for processing and ultimately provide an inexpensive header pipe.

5) By forming the hole 2 such that the longitudinal portions 3*a* of edge 3 are depressed, even if tube B is slightly deviated not only in the lateral direction but also in the vertical direction of tube B, such deviation or bend can be easily corrected, and tube B may be thus eventually inserted perpendicularly. It is thus possible to automate the assembling.

We claim:

1. In a coolant condenser having a pair of header pipes spanned by a plurality of heat exchange tubes having ends adapted to be inserted in slots in the header pipe, the improvement wherein each of the the header pipes has a plurality of longitudinal oblong slots uniformly spaced along the pipe transverse to the axis thereof adapted to receive an end of a flat tubular heat exchanger, said slots extending radially through the wall of said pipe and having an outside dimension broader than that of said tubular heat exchanger and the peripherally directed edges on the exterior surface of said pipe curved to flare radially outward to form a taper for insertion of said tubular heat exchanger.

2. The header pipe according to claim 1, wherein the longitudinally spaced ends of said slot are provided with an outwardly directed chamfer.

3. The method of forming the slots in the header pipe according to claim 1, comprising the steps of providing a core having an escapement hole conforming to the shape of said slot and having an outer dimension larger than said slot to be formed; inserting said core within said header pipe; and providing a punch conforming to the shape and having a size no greater than that of the slot to be formed; thrusting said punch through the wall of said pipe to move the material of said wall into said escapement hole before shearing of the material; and thereafter forming a slot having radially directed walls and an outwardly flaring curved edge on the exterior surface of the pipe.

4. The method of forming the slots in the header pipe according to claim 2, comprising the steps of providing a core having an escapement hole conforming to the shape of said slot and having an outer dimension larger than said slot to be formed; inserting said core within said header pipe; and providing a punch conforming to the shape and having a size no greater than that of the slot to be formed; thrusting said punch through the wall of said pipe to move the material of said wall into said escapement hole before shearing of the material; and thereafter forming a slot having radially directed walls and an outwardly flaring curved edge on the exterior surface of the pipe.

5. The method according to claim 3, including the step of chamfering the lateral ends of said slots in an outwardly flaring direction.

6. The method according to claim 4, including the step of chamfering the lateral ends of said slots in an outwardly flaring direction.

* * * * *